US008717125B2

(12) United States Patent
Ryou et al.

(10) Patent No.: US 8,717,125 B2
(45) Date of Patent: May 6, 2014

(54) TRANSMISSION LINE WITH LEFT-HAND CHARACTERISTICS INCLUDING AN INTERDIGITAL CAPACITOR WITH PARTIALLY OVERLAPPING FINGERS

(75) Inventors: Byung Hoon Ryou, Seoul (KR); Won Mo Sung, Siheung-si (KR); Gi Ho Kim, Anyang-si (KR)

(73) Assignee: EMW Co., Ltd., Incheon (KR)

( * ) Notice: Subject to any disclaimer, the term of this patent is extended or adjusted under 35 U.S.C. 154(b) by 153 days.

(21) Appl. No.: 12/440,921

(22) PCT Filed: Oct. 30, 2007

(86) PCT No.: PCT/KR2007/005375

§ 371 (c)(1),
(2), (4) Date: Sep. 30, 2009

(87) PCT Pub. No.: WO2008/054108

PCT Pub. Date: May 8, 2008

(65) Prior Publication Data

US 2010/0039193 A1 Feb. 18, 2010

(30) Foreign Application Priority Data

Oct. 30, 2006 (KR) ..... 10-2006-0105513

(51) Int. Cl.
*H01P 3/08* (2006.01)

(52) U.S. Cl.
USPC ..... 333/246; 333/185

(58) Field of Classification Search
USPC ..... 333/246, 238, 24 C, 1, 185; 257/531, 257/532
See application file for complete search history.

(56) References Cited

U.S. PATENT DOCUMENTS 3,024,403 A 3/1962 Zamites
3,784,937 A 1/1974 Jackson et al.

(Continued)

FOREIGN PATENT DOCUMENTS

JP 1996-321705 A 3/1996
JP 2001-077538 A 3/2001

(Continued)

OTHER PUBLICATIONS

PCT International Search Report for PCT Counterpart Application No. PCT/KR2007/005375 containing Communication relating to the Results of the Partial International Search Report, 2 pgs., (Feb. 4, 2008).

(Continued)

*Primary Examiner* — Benny Lee
(74) *Attorney, Agent, or Firm* — The PL Law Group, PLLC

(57) ABSTRACT

There is herein disclosed an interdigital capacitor, an inductor, and an LH transmission line and a coupler using the interdigital capacitor and the inductor. The interdigital capacitor comprises two finger sets which are substantially disposed in parallel with each other. Fingers of each finger set are overlapped at outer edges thereof with each other to thereby generate capacitance. The inductor is formed substantially spirally inside the transmission line, so that it can have a large inductance in a compact shape and can be used in a broad frequency band. The LH transmission line has a broad frequency band in a compact shape, which includes interdigital capacitors connected in series with each other and inductors connected in parallel with each other. In addition, the coupler employing the LH transmission line has an excellent couplability.

5 Claims, 4 Drawing Sheets

(56) References Cited

U.S. PATENT DOCUMENTS

| | | | | |
|---|---|---|---|---|
| 5,636,099 | A | 6/1997 | Sugawara et al. | |
| 5,929,729 | A * | 7/1999 | Swarup | 333/246 |
| 6,091,310 | A | 7/2000 | Utsumi et al. | |
| 6,170,154 | B1 | 1/2001 | Swarup | |
| 6,323,745 | B1 | 11/2001 | Toncich | |
| 6,445,056 | B2 * | 9/2002 | Nakashima | 257/532 |
| 6,448,873 | B1 * | 9/2002 | Mostov | 333/185 |
| 6,496,355 | B1 | 12/2002 | Galvagni et al. | |
| 6,518,864 | B1 | 2/2003 | Ito et al. | |
| 6,720,849 | B2 | 4/2004 | Sasaki et al. | |
| 6,825,734 | B2 | 11/2004 | Clark | |
| 6,958,729 | B1 | 10/2005 | Metz | |
| 6,970,055 | B2 * | 11/2005 | Toncich | 333/24 C |
| 7,071,797 | B2 * | 7/2006 | Ye | 333/204 |
| 7,190,014 | B2 | 3/2007 | Kao | |
| 7,330,090 | B2 | 2/2008 | Itoh et al. | |
| 2001/0017582 | A1 | 8/2001 | Sakata | |
| 2005/0225492 | A1 | 10/2005 | Metz | |
| 2006/0066422 | A1 | 3/2006 | Itoh et al. | |
| 2006/0086963 | A1 | 4/2006 | Wu | |

FOREIGN PATENT DOCUMENTS

| | | | |
|---|---|---|---|
| JP | 2002-151908 | | 5/2002 |
| JP | 2005-327814 | A | 11/2005 |
| KR | 10-2003-0071059 | | 9/2003 |
| KR | 20050081546 | A | 8/2005 |
| KR | 100802358 | B1 | 2/2008 |
| WO | WO 2005-084090 | A1 | 9/2005 |
| WO | WO 2008/023931 | A1 | 2/2008 |

OTHER PUBLICATIONS

Caloz, Christophe, et al., "A Novel Composite Right-/Left-Handed Coupled-Line Directional Coupler with Arbitrary Coupling Level and Broad Bandwidth", IEEE Transactions on Microwave Theory and Techniques, vol. 52, No. 3, pp. 980-992, (Mar. 2004).

Hoffmann, Reinmut K., "Circuit Components for Microstrip Circuits", Handbook of Microwave Integrated Circuits, pp. 91-93, (1987).

Jinghong Chen, et al., "Design and Modeling of a Micromachined High-*Q* Tunable Capacitor with Large Tuning Range and a Vertical Planar Spiral Inductor", IEEE Transactions on Electron Devices, vol. 50, No. 3, pgs. 730-739, (Mar. 2003).

Ju-Ho Son, et al., "Design of the Bluetooth Negative Resistor Oscillator using the Improved Spiral Inductor", Multimedia Academy, pgs. 325-331, (Apr. 2003).

1st Office action pertaining to corresponding JP application (application number: 2009-533258), 3 pgs.

Extended European Search Report for European Patent Application No. 07833683.1-2220, 9 pgs., (Mar. 28, 2011).

D. Stalculescu, et al., "Multilayer Embedded Metamaterial Optimization for 3D Integrated Module Applications," XP031017870, Antennas and Propagation Society International Symposium 2006, IEEE Albuquerque, NM, USA, pp. 4137-4140 (Jan. 1, 2006).

Horii et al., "Vertical multi-layered implementation of a purely left-handed transmission line for super-compact and dual-band devices", Microwave Conference, 2004, Piscataway, NJ, USA, IEEE, vol. 1, Oct. 11, 2004, pp. 471-473.

Yang et al., "Characteristics of Microstrip Lines through a Metalized EBG Substrate", Microwave Symposium Digest, 2006 IEEE MTT-S International, IEEE, PI, Jun. 1, 2006, pp. 1655-1658.

* cited by examiner

[Fig. 4]
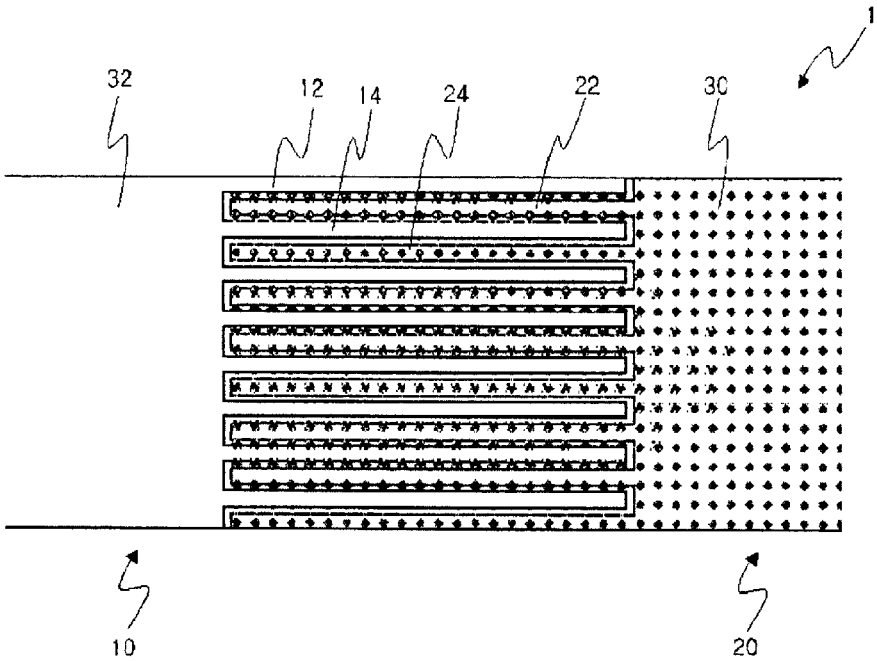
[Fig. 5]
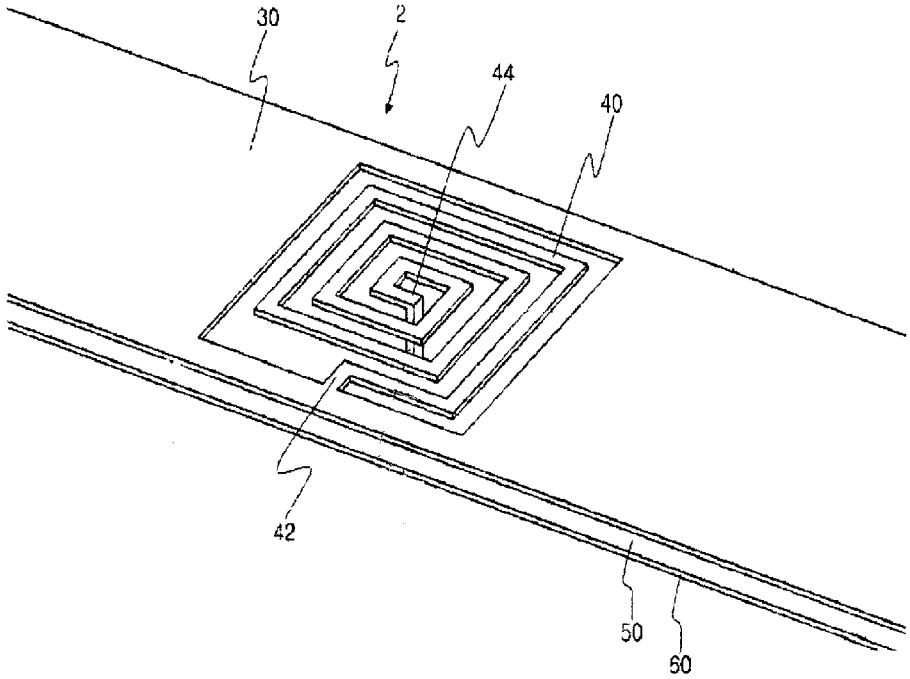

[Fig. 6]
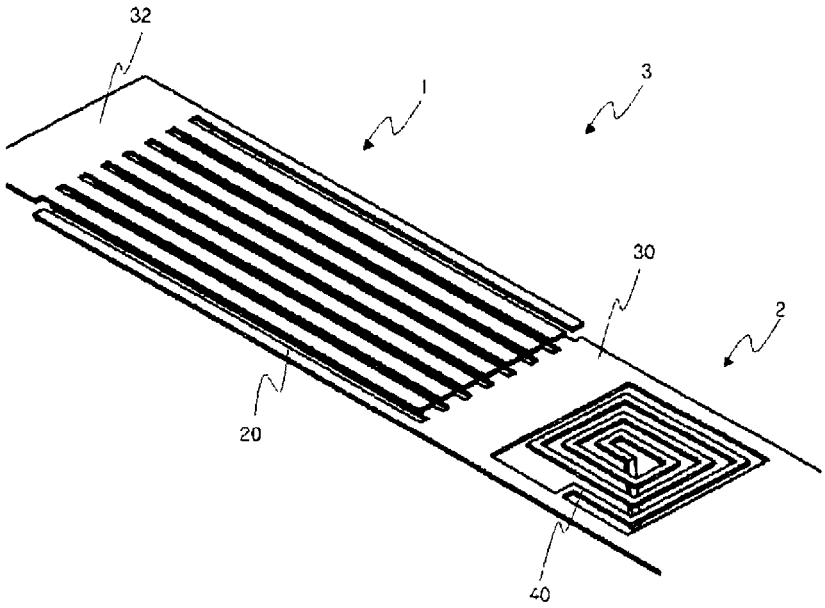

[Fig. 7]
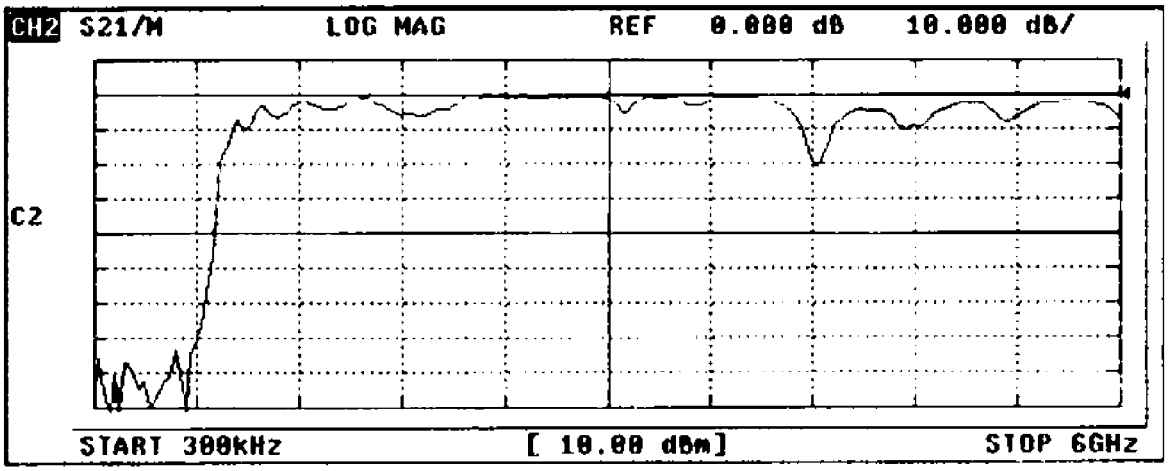
(a)
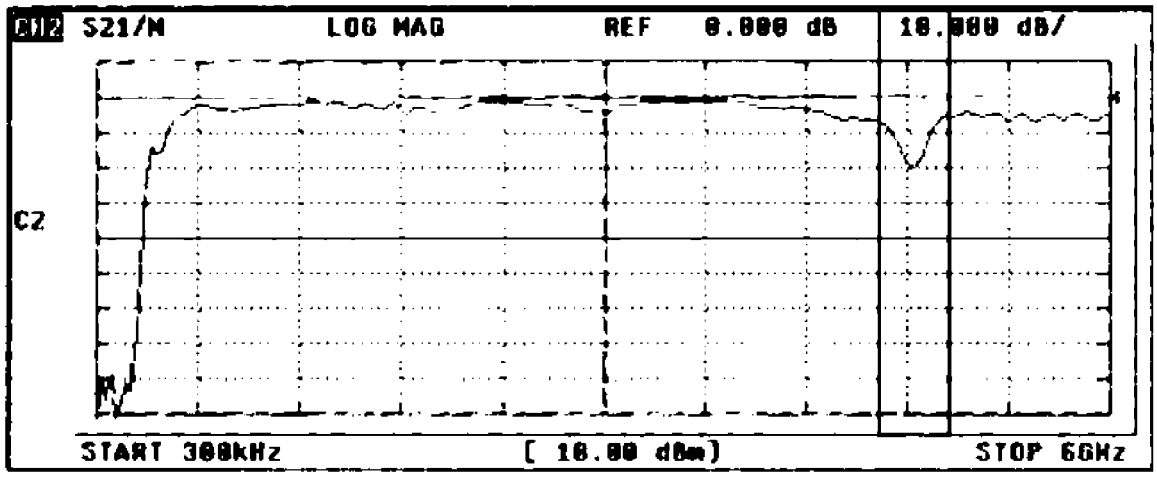
(b)

TRANSMISSION LINE WITH LEFT-HAND CHARACTERISTICS INCLUDING AN INTERDIGITAL CAPACITOR WITH PARTIALLY OVERLAPPING FINGERS

CROSS-REFERENCE TO RELATED APPLICATIONS

This patent application is a U.S. National Phase application under 35 U.S.C. §371 of International Application No. PCT/KR2007/005375, filed on Oct. 30, 2007, entitled INTERDIGITAL CAPACITOR, INDUCTOR, AND TRANSMISSION LINE AND COUPLER USING THEM, which claims priority to Korean patent application number 10-2006-0105513, filed Oct. 30, 2006.

TECHNICAL FIELD

The present invention relates to a transmission line and a coupler, and more particularly, to a left-Handed (LH) transmission line, a coupler using the LH transmission line, and a capacitor and an inductor for implementing the LH transmission line and the coupler.

BACKGROUND ART

Metamaterial refers to a material or an electromagnetic structure designed artificially to exhibit a special electromagnetic characteristic which cannot be generally found in the nature. The term Metamaterial as defined herein and in the present art, generally refers to a material or an electromagnetic structure having permittivity and permeability whose values are all negative numbers.

Such material is also referred as to a "double-negative (DNG) material" in terms of having two negative parameters. Metamaterial is also referred to as a "negative refractive index material (NRM)" in terms of having a negative reflection coefficient by negative permittivity and permeability. Metamaterial was originally researched by V. Veselago, a physicist of the Soviet Union in 1967, but after 30 years have passed since that research and application on a concrete implementing method is currently in progress.

Based on such characteristics, the electromagnetic waves inside Metamaterial are transferred by Fleming's left hand rule, but not Fleming's right hand rule. In other words, a phase propagation (phase velocity) direction and an energy propagation (group velocity) direction of the electromagnetic waves are opposite to each other. For this reason, Metamaterial is also referred to a left-handed material (LHM). Also, Metamaterial exhibits a non-linear relationship between $\beta$ (phase constant) and $\omega$ (frequency) as well as a characteristic in which its characteristics curve also exists in a left half plane of a coordinate plane. By virtue of such characteristics, Metamaterial enables implementation of a broad-band circuit due to a small phase difference according to frequencies, as well as enables implementation of a miniature circuit since a phase change is not proportional to the length of a transmission line.

Research on methods of implementing Metamaterial is in progress continuously, and among them, a method of implementing Metamaterial using a left-handed (LH) transmission line is known in the art.

FIG. 1 is a circuit diagram showing an equivalent circuit of a conventional transmission line and an LH transmission line according to the prior art.

As shown in FIG. 1(*a*), the equivalent circuit of the conventional transmission line is represented by a serial inductor $L_R$ and a parallel capacitor $C_R$. On the other hand, as shown in FIG. 1(*b*), the equivalent circuit of a Metamaterial transmission line, i.e., an LH transmission line is represented by a serial capacitor $C_L$ and a parallel inductor $L_L$. It has been known that a Metamaterial having the above-mentioned electromagnetic characteristics can be implemented by realizing such a transmission line.

Such an LH transmission line is implemented with the transmission line as shown in FIG. 2, which is disclosed in U.S. patent application Ser. No. 11/092,143, which issued as U.S. Pat. No. 7,330,090 on Feb. 12, 2008 to Itoh, et. al. The transmission line can be implemented using a known substrate such as an FR4 substrate, etc. Specifically, the transmission line includes a dielectric layer 400, an interdigital capacitor 100 and stub inductors 200 formed by printing, depositing or etching a first conductive element disposed on the top surface of the dielectric layer 400, and a ground plane 300 formed by printing, depositing or etching a second conductive element disposed on the underside of the dielectric layer 400.

[9] The serial capacitor C of the LH transmission line shown in FIG. 1(*b*) is implemented with the interdigital capacitor 100. The interdigital capacitor 100 is implemented to accomplish miniaturization of a device unlike a conventional multi-layered capacitor formed disposing a plurality of conductive layers on a dielectric layer and to be easily included in the transmission line. The serial capacitor C is configured such that sets of two fingers 110 and 120 are alternately arranged spaced apart from one another to have a capacitance by an electromagnetic coupling between the fingers. Each set of fingers 110 and 120 are electrically connected at one ends thereof to one another so that capacitances between a plurality of fingers, i.e., a capacitance between a finger 110*a* and a finger 120*a* and a capacitance between a finger 110*b* and a finger 120*b* are synthesized in parallel to have larger capacitance.

[10] In the meantime, the parallel inductor L of the LH transmission line is implemented with the stub inductor 200 as a short circuit stub. The stub inductor 200, which is an elongated conductor, is connected at one end thereof to the ground plane 300 through a via hole 210. The stub inductor 200 employing an inherent inductance of a general conductor has an inductance determined depending on its length. Thus, the transmission line which can be represented in FIG. 1(*b*) is implemented so that a transmission line having a desired length can be implemented through the cascade connection of a plurality of cells using a cell. In this case, capacitance and inductance occurring inevitably in each conductor exhibit an electrical characteristic in which the RH transmission line and the LH transmission line are combined.

The structural limitation of each constituent element of such a conventional LH transmission line contributes to restriction of performance improvement of the transmission line. First the interdigital capacitor 100 is disadvantageous in that its capacitance is smaller than a capacitance of a multi-layered capacitor. The reason for this is that the area of conductors electromagnetically connected opposite to one another is relatively small in the interdigital capacitor 100. Besides this, since it is required that the respective fingers should be formed to accurately intersect with one another in a criss-cross fashion, the interdigital capacitor 100 is very difficult to fabricate and process. The multi-layered capacitor has a demerit in that the adjustment of capacitance is performed only by adjusting the interval between the conductors and the area of the conductors, a degree of freedom of design is degraded, which generally makes it difficult to be used in the LH transmission line. U.S. patent application Ser. No.

10/904,825, which issued as U.S. Pat. No. 7,190,014 on Mar. 13, 2007 to Kao, and U.S. patent application Ser. No. 11/234,276, which published as U.S. Patent Publication No. 2006/0086963 on Apr. 27, 2006 to Wu and now abandoned, disclose a stacked interdigital plate capacitor structure. However, the above U.S. patents entail a problem in that since it has a similar construction as that of the multi-layered capacitor, a degree of freedom of design is decreased and its structure is complicated to thereby increase the manufacturing cost.

Meanwhile, since an inductance of the stub inductor 200 is determined depending on the length of the conductive element, the length of the conductive element must be increased so as to increase the inductance of the stub inductor, which results in an increase of the size of the inductor 200. In addition, in case where the wavelength of a signal is twice as long as the length of the stub inductor 200, the stub inductor 200 is operated as a $\lambda/2$ resonator so that a cutoff frequency appears in a frequency response as well as the inductor can be operated only in a length of less than ¼ of the wavelength in terms of an impedance characteristic. Thus, it is impossible to use the stub inductor 200 in a broad frequency band.

Due to the structural limitation of the interdigital capacitor 100 and the stub inductor 200, the conventional LH transmission line has a lot of limitations in expansion of the transmission band and miniaturization thereof.

SUMMARY OF THE INVENTION

Accordingly, an object of the present invention has been made to overcome the above-mentioned problems occurring in the prior art, and it is an object of the present invention to provide an interdigital capacitor which can increase its capacitance while maintaining a degree of freedom of design thereof and is easy to fabricate.

Another object of the present invention is to provide an inductor which can be fabricated in a compact size and does not have a cutoff frequency.

An ultimate object of the present invention is to provide an LH transmission line which has a broad transmission band and is compact, and a coupler using the LH transmission line.

To accomplish the above object, according to one aspect of the present invention, there is provided a capacitor comprising: a first set of fingers including at least two fingers disposed spaced apart from each other and connected at one ends thereof to each other; and a second set of fingers including at least two fingers disposed spaced apart from each other and connected at one ends thereof to each other, the second finger set being spaced apart from the first finger set by a predetermined interval in such a fashion as to be substantially in parallel with the first finger set.

Preferably, the capacitor may further comprise a dielectric substrate disposed between the first finger set and the second finger set.

Also, the width of each finger of the first finger set may be larger than that of each finger of the second finger set so that fingers of the first finger set are at least partially overlapped with fingers of the second finger.

According to another aspect of the present invention, there is provided an inductor which is connected at one end thereof to a transmission line and is connected at the other end thereof to a ground plane, the inductor being formed inside the transmission line in such a fashion as to have a substantially spiral shape.

Preferably, the inductor may be formed on a dielectric substrate, and may be connected at the other end thereof to the ground plane through a via hole.

According to another aspect of the present invention, there is provided a transmission line having an LH characteristic, comprising: a capacitor which comprises: a first set of fingers including at least two fingers disposed spaced apart from each other and connected at one ends thereof to each other; and a second set of fingers including at least two fingers disposed spaced apart from each other and connected at one ends thereof to each other, the second finger set being spaced apart from the first finger set by a predetermined interval in such a fashion as to be substantially in parallel with the first finger set; and an inductor which is connected at one end thereof to the second finger set and is connected at the other end thereof to a ground plane.

Preferably, the capacitor may further comprise a dielectric substrate disposed between the first finger set and the second finger set.

Also, the width of each finger of the first finger set may be larger than that of each finger of the second finger set so that fingers of the first finger set are at least partially overlapped with fingers of the second finger.

In the meantime, preferably, the inductor may be connected to the second finger set through the transmission line. In this case, the inductor may be connected at one end thereof to the transmission line and may be connected at the other end thereof to a ground plane, the inductor being formed inside the transmission line in such a fashion as to have a substantially spiral shape.

In addition, preferably, the inductor may be formed on a dielectric substrate, and may be connected at the other end thereof to the ground plane through a via hole.

According to another aspect of the present invention, there is provided a coupler comprising the transmission line having the LH characteristic.

As described above, according to the present invention, it is possible to provide an interdigital capacitor which can increase its capacitance while maintaining a degree of freedom of design thereof and is easy to fabricate.

In addition, an inductor can be obtained which is fabricated in a compact size and does not have a cutoff frequency. Ultimately, it is possible to obtain an LH transmission line which has a broad transmission band and is compact, and a coupler using the LH transmission line.

BRIEF DESCRIPTION OF THE DRAWINGS

FIG. 4 is a top plan view showing an interdigital capacitor according to one embodiment of the present invention;

FIG. 5 is a perspective view showing an inductor according to another embodiment of the present invention;

FIG. 6 is a perspective view showing an LH transmission line according to another embodiment of the present invention; and FIG. 7 is FIGS. 7*a* and 7*b* are graphs showing an S21 parameter of an LH transmission line according to one embodiment of the present invention.

DETAILED DESCRIPTION

Reference will now be made in detail to a preferred embodiment of the present invention with reference to the attached drawings.

As used herein, the terms "inductor", "capacitor" and "transmission line" are defined to exhibit a superior electrical characteristic in their devices and constituent elements. This does not means that the devices and constituent elements are operated only by the inductor, the capacitor and the transmission line.

Figure 1A:
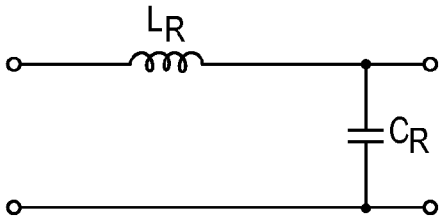
FIG. 1A (PRIOR ART)
FIGS. 1*a* and 1*b* are circuit diagrams showing an equivalent circuit of a conventional transmission line and an LH transmission line, respectively, according to the prior art.
Figure 1B:
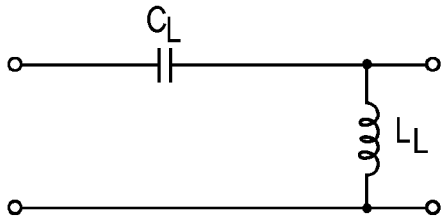
FIG. 1B (PRIOR ART)
Figure 2:
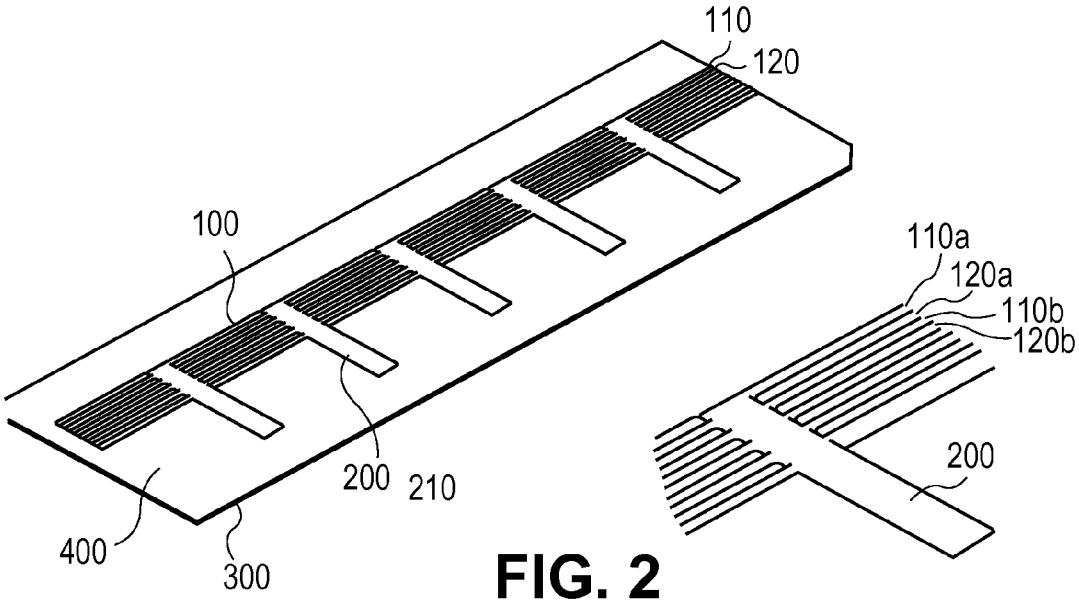
FIG. 2 (PRIOR ART)
FIG. 2 is a perspective view showing a conventional LH transmission line which is actually implemented.
Figure 3:
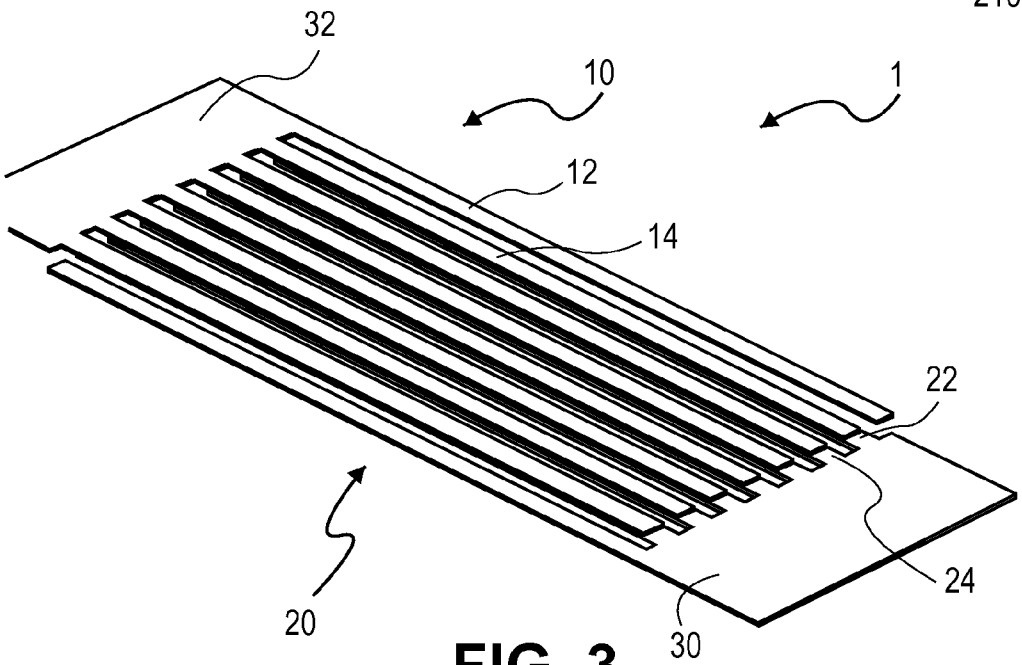
FIG. 3 is a perspective view showing an interdigital capacitor according to one embodiment of the present invention.

FIG. 3 is a perspective view showing an interdigital capacitor 1 according to one embodiment of the present invention.

The interdigital capacitor 1 comprises two sets of fingers 10 and 20 that are substantially disposed in parallel with each other. The two finger sets 10 and 20 include two pairs of fingers 12, 14 and 22, 24, respectively, each pair of fingers being disposed spaced apart from each other and connected at one ends thereof to each other.

Now, only some of fingers shown in the drawing will be described hereafter, but is not limited thereto in the present invention. Besides the fingers shown or described, the following description can be applied to the fingers irrespective of the number of fingers.

The two sets of fingers 10 and 20 are disposed spaced apart from each other in such a fashion as not to be electrically connected to each other, and a dielectric substrate (not shown) may be disposed between the two finger sets for the sake of convenience of fabrication and structural stability.

Particularly, since a capacitance of a plate capacitor is proportional to a permittivity, high-permittivity dielectric substrate may be interposed between the two finger sets 10 and 20 to thereby increase the capacitance of the capacitor. A first pair of fingers 12 and 14 and a second pair of fingers 22 and 24 are commonly connected to transmission lines 32 and 30, respectively, so that capacitances therebetween can be synthesized in parallel. Also, the transmission lines 30 and 32 to which the first and second finger pairs are connected constitute terminals of the capacitor to cause current to flow in and out therethrough as illustrated in FIGS. 3 and 4.

Preferably, the first finger pair 12 and 14 and the second finger pair 22 and 24 are formed to have the same length so that they are arranged to be overlapped with each other. The arrangement of the fingers will be described hereinafter with reference to FIG. 4.

Referring to FIG. 4, the first finger pair 12 and 14 and the second finger pair 22 and 24 are arranged in such a fashion as to be alternately interlaced with each other. In this case, the first finger pair 12 and 14 and the second finger pair 22 and 24 may be arranged so as to be overlapped at least at outer edges thereof with each other. That is, for example, the width of the finger 22 is formed to be larger than a distance between fingers, i.e., a distance between the fingers 12 and 14 so that the finger 22 can be overlapped at outer edges thereof with the fingers 12 and 14. Likewise, the first and second finger sets 10 and 20 are disposed in parallel with each other in such a fashion as to be at certain regions thereof overlapped with one another so that the interdigital capacitor 1 has a relatively increased overlapped area between conductors as compared to the conventional interdigital capacitor to thereby increase the capacitance thereof.

Further, since the first and second finger sets 10 and 20 are formed on different layers, respectively, the alternate arrangement between the fingers do not need to be sophisticatedly implemented, and difficulty and cost of the fabrication of the interdigital capacitor 1 is reduced relatively as compared to the conventional interdigital capacitor.

The interdigital capacitor 1 is composed of two finger sets 10 and 20 each including more than two fingers similarly to the conventional interdigital capacitor so as to increase a degree of freedom of design. Specifically, the capacitance of the interdigital capacitor 1 ca be changed by the change in the distance between fingers, the distance between two finger sets 10 and 20, the number of fingers included in each of the two finger sets 10 and 20, the permittivity of the dielectric substrate, etc. This permits a relatively high degree of freedom of design as compared to the conventional multi-layered capacitor whose capacitance varies depending on only the size of a conductor, the distance between conductors and the permittivity of the dielectric substrate.

An inductor according to another embodiment of the present invention will be described hereinafter with reference to FIG. 5.

In this embodiment, the inductor 2 includes a strip conductor 40 disposed in a spiral shape in an opening formed inside of a conductor 30 serving as a transmission line. The conductor 30 and the strip conductor 40 may be formed on the top surface of a dielectric substrate by means of printing, deposition, etching or the like. Also, a ground plane 60 can be formed on the underside of the dielectric substrate 50. The strip conductor 40 is connected at one end 42 thereof to the conductor 30 and is connected at the other end 44 thereof to the ground plane 60 through a via hole.

The strip conductor 40 is operated as an inductor by the inductance inherent to the conductor. But, the strip conductor 40 is formed to have a substantially spiral shape dissimilarly to the conventional stub inductor so that its length can be extended even in a narrow area and its inductance can be increased to thereby accomplish miniaturization thereof.

In the spiral strip conductor 40, capacitance occurs between respective sections of the strip conductor 40 which are in parallel disposed spaced apart from each other. However, this capacitance is negligibly smaller as compared to inductance caused by the entire strip conductor 40, and resultantly the inductor 2 is operated as an inductor element. Likewise, the inductor 2 is operated as a discrete circuit component or lumped inductor in which both the capacitance and the inductance greater than the capacitance exist dissimilarly as the stub inductor which is operated as a distributed constant circuit basically having the construction of the transmission line. Thus, a resonant frequency of the inductor 2 is merely determined by inductance and capacitance inside thereof, and the inductor 2 is not operated as the $\lambda/2$ resonator. In addition, unlike the conventional stub inductor which can be operated as an inductor only when it has a length of less than ¼ of a wavelength, the inductor 2 has no limitation in a wavelength range at which the inductor can be operated. Therefore, the inductor 2 does not have a cutoff frequency proportional to the size of the inductor and can be operated an inductor in a broad frequency band.

Moreover, since the inductor 2 in this embodiment is disposed in the opening formed inside of the transmission line 30, a circuit space for the inductor 2 to be occupied can be minimized. Particularly, in case where the inductor 2 is formed to be connected to the interdigital capacitor, the capacitor and the inductor 2 can be easily connected to each other.

An LH transmission line according to another embodiment of the present invention using the interdigital capacitor 1 and the inductor 2 will be described hereinafter with reference to FIG. 6.

In this embodiment, the interdigital capacitor 1 and the inductor 2 are the same in construction as those described with reference to FIGS. 3 and 5. The same elements are indicated by the identical reference numeral, but the present invention is not limited thereto.

An LH transmission line 3 includes the interdigital capacitor 1 and the inductor 2. The capacitor 1 and the inductor 2 are connected to each other by means of a transmission line 30.

That is, the transmission line 30 is connected one side thereof to the second finger set 20 of the interdigital capacitor 1, and is connected at the other side thereof to the spiral strip conductor 40 of the inductor 2 and simultaneously serves to a second port of the LH transmission line. A first port of the LH transmission line 3 is the transmission line 32 connected to the first finger set 10 of the interdigital capacitor 1.

With this configuration, the interdigital capacitor 1 is connected between the first port of the transmission line 32 and the second port of the transmission line 30 of the LH transmission line 3, the inductor 2 is connected between the second port of the transmission line 30 and the ground plane, so that the LH transmission line 3 including a serial capacitor and a parallel inductor is obtained. In addition, the LH transmission line 3 is used as a cell and more than two LH transmission lines are cascade-connected to each other so that a transmission line having a desired length can be obtained.

In this embodiment, the LH transmission line 3 has a high degree of freedom of design, and includes the interdigital capacitor 1 having a large capacitance and the inductor 2 enabling miniaturization and having no a cutoff frequency, so that it can extend a frequency bandwidth and can be miniaturized dissimilarly to the conventional LH transmission line. Besides, the inductor is formed inside the transmission line 30, so that the second finger set 20 can be extended as it is so as to be connected to the inductor, which makes it very simple to fabricate the LH transmission line 3.

In this embodiment, the performance of the LH transmission line was measured through its actual implementation. Also, the conventional LH transmission line was fabricated and was used as a comparative embodiment.

In the implemented LH transmission line, each finger of the interdigital capacitor was 6 mm in length and was 0.2 mm in width, and the distance between adjacent fingers was 0.1 mm. In this case, eight fingers per each finger set were used. In addition, the spaced distance between the firs and second finger sets was 0.1 mm and a dielectric substrate having a permittivity of 1 was interposed between the fingers. The width of the strip conductor of the inductor 2 was 0.1 mm, the distance between the respective sections of the spiral strip conductor was 0.1 mm, and the entire size of the inductor, i.e., the distance from a connection portion between the strip conductor and the transmission line to the outermost portion of the spiral section was 1.9 mm.

In the LH transmission line according to the comparative embodiment, the length of each finger of the interdigital capacitor 1 was 6 mm, and five fingers per each finger set was used. In this case, the stub inductor was formed to have a length of 10 mm and a width of 1 mm.

In both the inventive embodiment and the comparative embodiment, the transmission lines were realized using a dielectric substrate having a permittivity of 4. The size of the transmission line including six capacitors and the five inductors was $48\times2.4\ (\text{mm})^2$ in the inventive embodiment, and was $37\times12.2\ (\text{mm})^2$ in the comparative embodiment, respectively.

FIGS. 7(*a*) and 7(*b*) are graphs showing an S21 parameter of an LH transmission line according to one embodiment of the present invention, wherein FIG. 7 (a) shows an S1 parameter of the comparative embodiment and FIG. 7(*b*) shows an S1 parameter of the inventive embodiment.

These parameters were measured in a frequency band range from 300 kHz to 6 GHz. As shown in FIG. 7(*a*), the S21 parameter of the comparative embodiment had a cutoff frequency at 1 GHz and 4 GHz relative to −3 dBm whereas the S21 parameter of the inventive embodiment of FIG. 7(*b*) had a cutoff frequency at 0.5 GHz and 4.4 GHz relative to −3 dBm. Thus, the bandwidth in the inventive embodiment was 900 MHz, which was further increased by about 30% as compared to the comparative embodiment. In other word, according to the inventive embodiment, it could be found that the realized area of the transmission line is further decreased by about 75% and the bandwidth is further increased by about 30% as compared to the comparative embodiment.

According to another embodiment of the present invention, it is possible to use an inductor formed on a layer separate from the transmission line, or a helical shaped inductor as a parallel inductor of the LH transmission line. The detailed description of these inductors is disclosed in Korean Patent Application No. 2006-79326, the content of which is incorporated herein by reference although it is not described in detail herein.

According to another embodiment of the present invention, a coupler using the inventive LH transmission line as described above is provided. In this embodiment, the coupler is configured such that a pair of LH transmission lines is deposed in parallel with each other to have four ports. An input port and an output port of a first transmission line are used as an input port and a through port of the coupler, respectively. An input port of a second transmission line is used as a coupled port. An output port of the second transmission line is used as an isolation port, which is not used as input and output ports.

The coupler of this embodiment employs the inventive LH transmission line so that it can be fabricated compactly and has a broad-band characteristic. Further, the inventive coupler exhibits a remarkably improved couplability as compared to a coupler employing the conventional LH transmission line.

Similarly to what described in the previous inventive embodiment and the comparative embodiment, each of the conventional LH transmission line including six capacitors and the five inductors and the inventive LH transmission line were used in one pair to implement the coupler. At this time, the couplability of the inventive coupler and the couplability of the conventional coupler were compared. The respective transmission lines were disposed at an interval of 0.2 mm, and the distance between fingers of the capacitor was 0.08 mm. In case of the inductor, its size was 1.85 mm and the distance between strip conductors was 0.15 mm. As a result, the inventive coupler and the conventional coupler exhibit couplabilities of −6 dB and −3 dB, respectively. It could be found that the inventive coupler has a couplability increased by 3 dB as compared to the conventional coupler.

While the invention has been described in connection with what is presently considered to be practical exemplary embodiments, it is to be understood that the invention is merely exemplary and not limited to the disclosed embodiments. The constituent elements described in the above embodiments can be replaced with their equivalents or a method of forming them can be modified in various manners by a person skilled in the art, and such replacement and modification is carried out without departing from the scope of the invention. Therefore, the scope of the present invention is not limited by or to the embodiments as described above, and should be construed to be defined only by the appended claims and their equivalents.

What is claimed is:

1. A transmission line comprising:

a first set of fingers including at least two fingers disposed spaced apart from each other and connected at one end thereof to each other;

a second set of fingers including at least two fingers disposed spaced apart from each other and connected at one end thereof to each other, the second finger set being spaced apart from the first finger set by a predetermined interval in such a fashion as to be substantially in parallel with the first finger set, wherein the width of each finger of the first finger set is larger than the width of each finger of the second finger set so that fingers of the first finger set are at least partially overlapped with fingers of the second finger set;

a dielectric substrate disposed between the first finger set and the second finger set; and an inductor which is connected at one end thereof to the second finger set and is connected at the other end thereof to a ground plane.

2. A transmission line having an LH characteristic, comprising:

a capacitor which comprises: a first set of fingers including at least two fingers disposed spaced apart from each other and connected at one end thereof to each other; and a second set of fingers including at least two fingers disposed spaced apart from each other and connected at one end thereof to each other, the second finger set being spaced apart from the first finger set by a predetermined interval in such a fashion as to be substantially in parallel with the first finger set;

and an inductor which is connected at one end thereof to the second finger set and is connected at the other end thereof to a ground plane, wherein the width of each finger of the first finger set is larger than the width of each finger of the second finger set so that fingers of the first finger set are at least partially overlapped with fingers of the second finger set.

3. The transmission line according to claim 2, wherein the capacitor further comprises a dielectric substrate disposed between the first finger set and the second finger set.

4. The transmission line according to claim 2, wherein the inductor is connected to the second finger set through the transmission line, the inductor being formed inside the transmission line in such a fashion as to have a substantially spiral shape.

5. The transmission line according to claim 4, wherein the inductor is formed on a dielectric substrate, and is connected at the other end thereof to the ground plane through a via hole.

* * * * *